United States Patent [19]

Ruff

[11] 4,275,645

[45] Jun. 30, 1981

[54] CLOSURE FOR SERVICE OPENING

[75] Inventor: Alonzo W. Ruff, York, Pa.

[73] Assignee: Expertise Assistance Inc., York, Pa.

[21] Appl. No.: 96,622

[22] Filed: Nov. 21, 1979

Related U.S. Application Data

[63] Continuation-in-part of Ser. No. 923,316, Jul. 10, 1978, abandoned.

[51] Int. Cl.[3] ..... F24F 9/00

[52] U.S. Cl. ..... 98/36; 62/256; 160/120

[58] Field of Search ..... 98/36; 62/248, 256, 62/255; 160/41, 120, 121, 264

[56] References Cited

U.S. PATENT DOCUMENTS

| | | | |
|---|---|---|---|
| 2,780,283 | 2/1957 | Wasserman | 160/264 X |
| 3,038,400 | 6/1962 | Ruff | 98/36 |
| 3,231,006 | 1/1966 | Fisher et al. | 160/41 |
| 3,886,851 | 6/1975 | Berner | 98/36 |
| 4,117,698 | 10/1978 | Vogel | 62/256 |

FOREIGN PATENT DOCUMENTS

| | | | |
|---|---|---|---|
| 2749037 | 5/1979 | Fed. Rep. of Germany | 160/120 |

*Primary Examiner*—Albert J. Makay

*Assistant Examiner*—Harold Joyce

*Attorney, Agent, or Firm*—Kemon & Estabrook

[57] ABSTRACT

A closure for a service opening in a wall separating a frozen storage area from a warm area such as a kitchen or a warehouse loading dock includes at least a pair of spaced flexible curtain members. The curtains are fastened at one end to spaced parallel spring-loaded rollers positioned below the opening and are joined at their opposite ends in an elongated nozzle and connected by cables to power operated pulleys or drums positioned above the opening. The drums are declutchable from the power train to permit the spring-loaded rollers to wind up the curtains to open position and the clutch is re-engaged and the power drive actuated to unwind the curtains from the rollers to close the opening. A plenum chamber housing the rollers is pressurized to force warm side air between the curtains and out of the nozzle to create an air curtain across the opening when the curtains are open and during opening and closing cycles. The flow of air also maintains the curtain spacing for insulation purposes; prevents condensation build up and in one embodiment effects a seal between the curtain and vertical guide members which receive the curtain edges.

6 Claims, 7 Drawing Figures

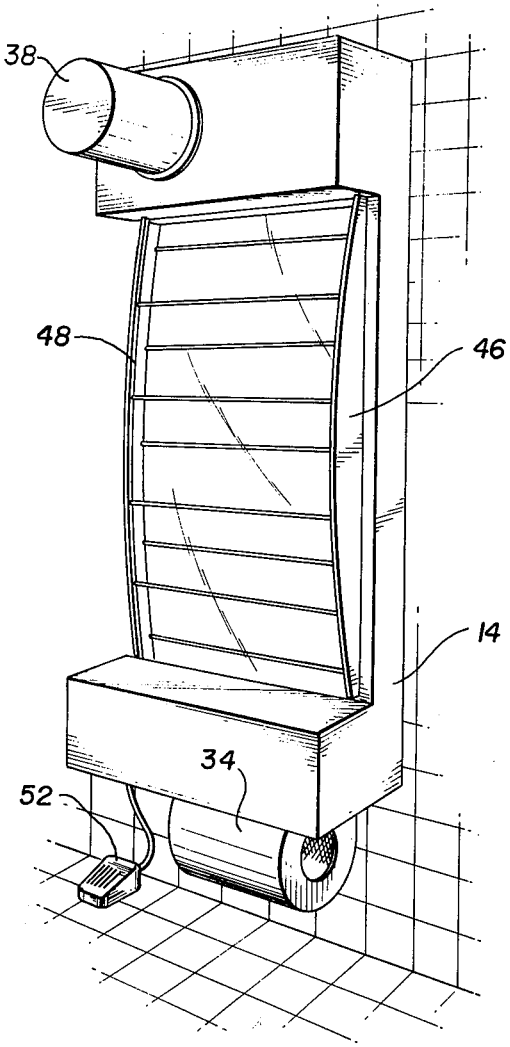
FIG.1
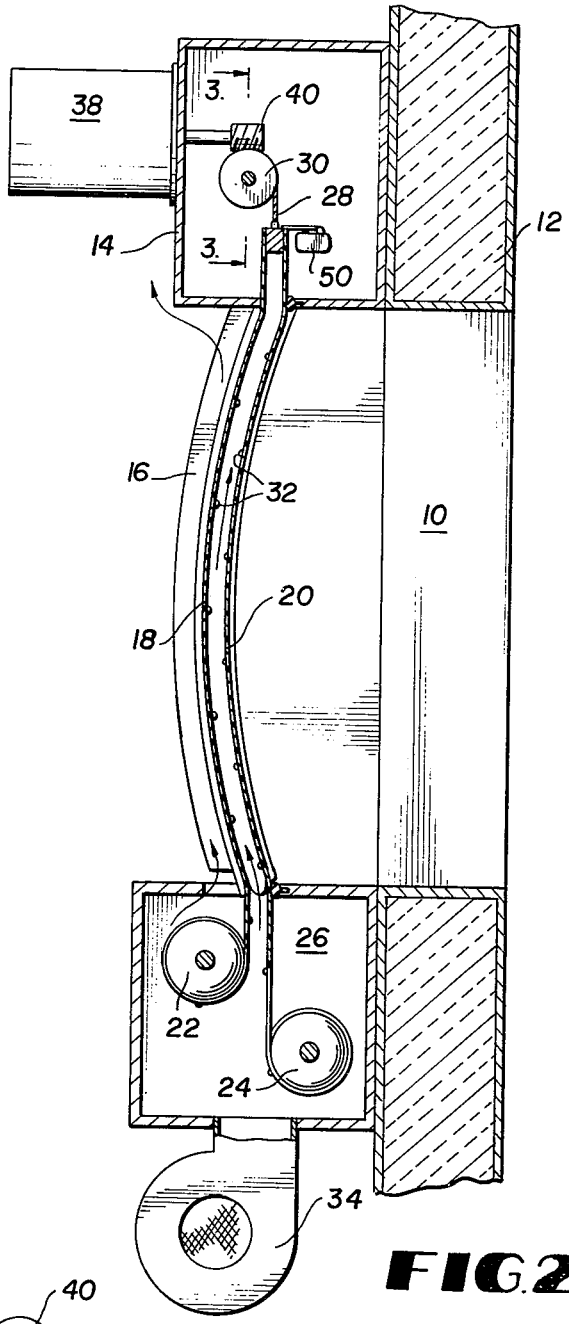
FIG.2
FIG.3
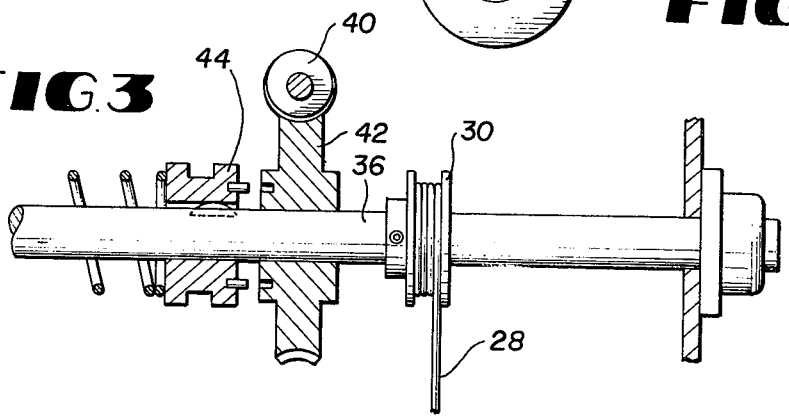

CLOSURE FOR SERVICE OPENING

BACKGROUND OF THE INVENTION

This is a continuation-in-part of Ser. No. 923,316, filed July 10, 1978 now abandoned.

With the rapid growth of the so-called "fast food" restaurants, there has developed a need for a practical closure for a service opening in an insulated wall separating, for example, the kitchen area from the frozen food storage area. In this type of merchandising operation, articles such as hamburgers, french fried potatoes and the like are kept frozen until cooked on order for a patron. A conventional swinging service door is less than a complete answer for a number of reasons. In the first place, there is the likelihood of less than full closing to latched position due to the frequency of the use and inattention of the personnel concerned in the rush of giving fast service. Also, there is a pumping action which takes place in opening and closing a conventional swinging closure which tends to pump cold air out and warm moist air into the cold storage area. Additional moisture is detrimental to the overall operation costs due to frost and ice build-up on the heat exchange surfaces as well as the food items themselves and the other surfaces in the cold area. Still another disadvantage of the conventional swinging closure in this environment is the space required for movement of the closure to open position in a busy work area.

Similar problems exist in commercial warehousing operations involving passage of case lots of foods through service openings in insulated walls which separate cold storage from warm areas. Such walls could be either a part of a warehouse building or they could be walls of a comfort conditioned vehicle which is operated within the warehouse in the order picking tunnels to make up orders for transport to a remote point of use. There are numerous requirements for service opening closures which are common to each of these environments and which are solved by the present invention. First, the closure member should operate quickly with maximum torque at the initiation of the opening cycle and minimum torque at the end of the opening cycle. Second, the transfer of air in both directions across the opening should be minimized during times when the closing member is moved in either opening or closing modes as well as when it is maintained in opened position for the passage of produce therethrough. Third, condensation and/or frost build-up on the surfaces of the closure member and adjoining frame should be prevent. Fourth, the closure member itself should be a substantial heat barrier. Fifth, the closure member should be sealed against air leakage when in the closed position and sixth, the closure member should be light in weight to minimize energy requirements for opening and closing. The latter is particularly important in the fast food restaurant environment where there are generally a very large number of opening and closing cycles during any given operating period.

BRIEF SUMMARY OF THE INVENTION

A closure in accordance with the present invention includes at least two spaced parallel flexible curtains. The curtains are fastened at their lower end to spaced parallel spring-loaded rollers positioned below the service opening and they are connected together at their opposite ends and linked by cables or the like to power drums or pulleys located above the service opening.

The rollers are enclosed in a plenum chamber which is pressurized in order to circulate air from the warm side of the opening between the two curtains and also over the outer surface of the warm side of the closure to prevent condensation, maintain the spacing between the two curtains when in the closed position, maintain an air curtain across the opening when open and during opening and closing cycles and in one embodiment maintain the edges of the curtains in sealing engagement with vertical side rails along the edge of the opening.

BRIEF DESCRIPTION OF THE DRAWINGS

FIG. 1 is a perspective view of one embodiment of a closure in accordance with the present invention, shown in closed position;

FIG. 2 is a side elevation partially in section of the closure of FIG. 1;

FIG. 3 is a plan view partially in section of portions of the power drive train;

DETAILED DESCRIPTION

Figure 5:
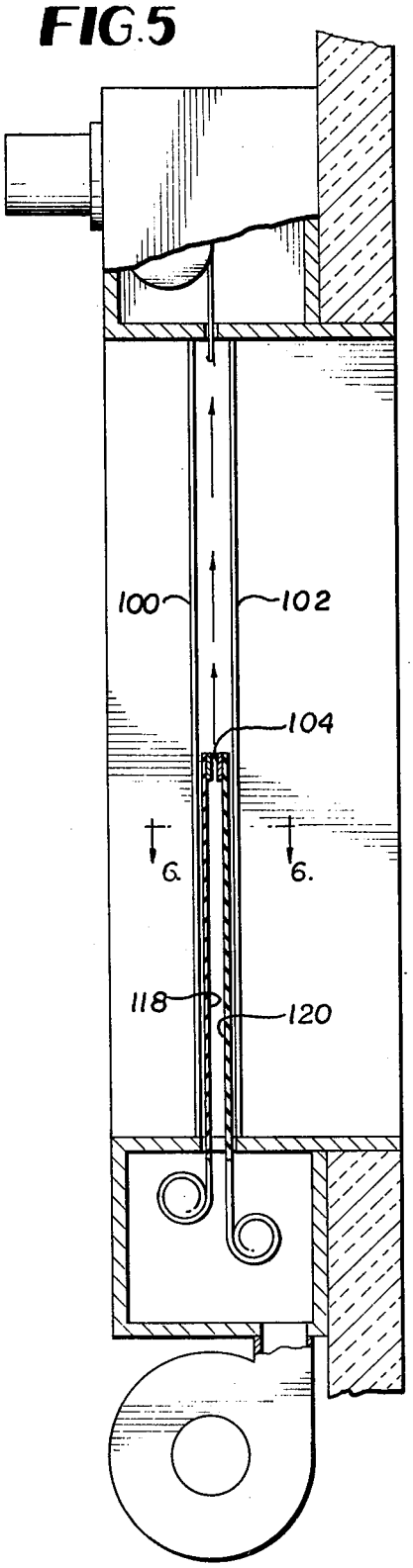
FIG. 5 is a side elevation of an alternative embodiment.

Referring to the drawing, a first embodiment of the present invention is shown for a service opening 10 in an insulated wall 12 which separates a frozen food storage area from a kitchen or other relatively warm work area. The closure of the present invention is contained within a housing 14 having an opening 16 corresponding to and aligned with the opening 10 in the wall 12. The movable closure assembly includes a pair of flexible curtains 18 and 20 connected at one end to spring-loaded rollers 22 and 24 located in a plenum chamber 26 at the lower end of the housing 14. The ends of the curtains remote from the rollers are joined in any convenient manner and connected by cables 28 to pulleys or drums 30 mounted in the upper portion of the housing 14 above the service opening. Preferably, the curtains are formed of transparent synthetic resin and reinforced by spaced parallel stiffening strips or ribs 32. The plenum chamber 26 which houses the spring-loaded rollers is pressurized by means of a fan 34 to cause circulation of warm-side air between the curtains 18 and 20 and also along the warm side of the curtain 18. This is effective to maintain the spacing between the curtains for insulation purposes and also to prevent the build-up of condensation on the curtains themselves. The upper edges of the curtains are joined to a "knife edge" nozzle so that when in the open position, an air curtain is established across the opening.

As shown in FIG. 3, the pulleys 30 are connected to a shaft 36 arranged to be driven from a motor 38 through a worm 40 and a worm gear 42. The worm gear 42 is free to rotate on the shaft 36 but forms a driving connection therewith when the clutch of which the gear 40 is a part is engaged. The other member of the clutch is shown at 44 and it is splined to the shaft for movement between clutch engaged and clutch disengaged positions.

In order that there will be an effective seal of the opening when the curtains are in the closed position, a pair of outwardly curved side members 46 and 48 substantially coextensive in height with the path of travel of the curtains are positioned on either side of the path of travel. Opposite edges of the flexible curtains, therefore, when in the position shown in FIG. 2, for example, engage with and seal against these surfaces due to the tension in the fabric caused by the spring force in the rollers 22 and 24.

With the curtains fully wound on the spring-loaded rollers 22 and 24, corresponding to a fully opened position of the closure, the opening may be closed by energizing the motor 38 and engaging the clutch members 42 and 44 to rotate the shaft 36 and the pulleys 30 which will draw the curtains up over the side seal surfaces 46 and 48 until the closure is in the position illustrated in FIG. 2. A limit switch indicated at 50 will serve to de-energize the motor automatically when the curtains reach that level. When it is desired to open the curtains, a switch such as a floor switch indicated at 52 in FIG. 1 may be closed to disengage the clutch elements 42 and 44 which releases the shaft 36 for free running rotation. The curtains are then rewound on the spring-loaded rollers 22 and 24 solely by the force of the springs to open the closure and permit access through the openings 16 and 10 to the frozen products on the cold side of the wall 12. It should be noted that the rollers will exert a maximum torque at the beginning of the opening cycle and their torque diminishes as the opening progresses and is a minumum when fully open. This is an ideal situation because it insures a rapid opening coupled with a minimum shock at the close of the opening cycle.

The closure assembly as described above may be permanently located over the service opening, or it may be mounted on rails for sliding movement along the wall 12. The advantage to the slideably mounted arrangement is that a conventional swinging closure may be used during non-service hours and may be locked in closed position for security purposes.

Referring now to FIG. 5, which shows an alternative embodiment useful in either the fast food restaurant environment previously described or in other environments such for example as shown in my prior U.S. Pat. No. 3,038,400.

Figure 6:
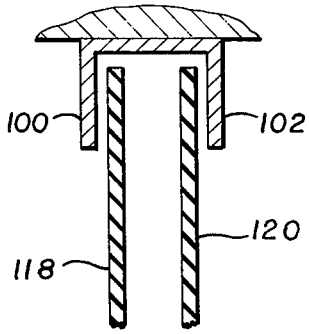
FIG. 6 is a section on the line 6—6 of FIG. 5.
Figure 7:
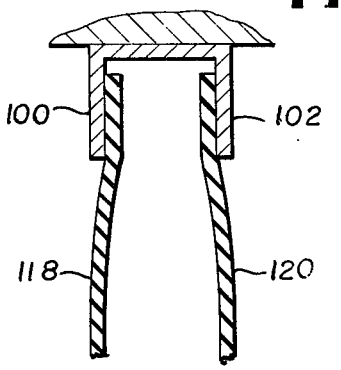
FIG. 7 is similar to FIG. 6 but indicates the position of the curtains when the plenum chamber is pressurized.

In this embodiment the bowed front members 46 and 48 of FIG. 1 are replaced by two pairs of vertical rails 100 and 102, one on each side of the opening. Each pair could be in the form of a U-shaped channel member as indicated in FIGS. 6 and 7 or the rails could be separate elements. They are simply intended to define a vertical guideway between which the curtains 118 and 120 ride as they move through opening and closing cycles. In the closed position of the curtains, air pressure between them is effective to force the side edges into sealing engagement with the rails and thus prevent the leakage of air through the opening.

Figure 4:
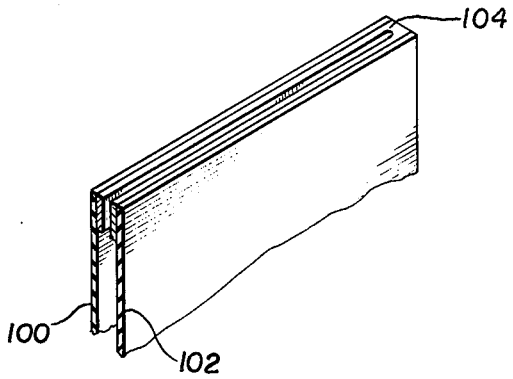
FIG. 4 is a perspective view of an elongated nozzle which joins the upper ends of the curtains.

In both embodiments, pressurizing of the plenum chamber which houses the spring-loaded rollers at the lower end of the opening is used to establish an air curtain across the opening when the closure is opened and during opening and closing cycles. The upper edges of the curtains are conveniently joined in an elongated nozzle indicated at 104 in FIG. 4 which directs the air from the plenum is a continuous sheet across the opening. In the first embodiment it may be desirous to discontinue pressurization of the plenum chamber whenever the curtains are closed because the side edges are sealed due to tension in the curtains which tension is maintained by the spring-loaded rollers. In the second embodiment, it is desirable to maintain pressurization of the plenum chamber during periods when the curtains are closed in order to maintain the side edges of the curtains in sealing engagement with the vertical rails. A reduction in pressure for this purpose, however, is contemplated in order to reduce energy requirements and prevent excessive outward ballooning of the curtains which could otherwise occur once the nozzle at the upper edges becomes blocked or partially blocked by engagement with the upper side of the frame surrounding the opening. Such pressure reduction is easily accomplished by way of a two speed fan controlled by movements of the closure member so as to maintain high speed while open and during opening and closing movements and low speed when closed.

While preferred embodiments of the present invention have been herein shown and disclosed, Applicant claims the benefit of a full range of equivalents within the scope of the appended claims.

I claim:

1. A power operated closure for a service opening in a wall between a warm area and, for example a frozen product storage area comprising:

at least a pair of flexible curtain members;

an equal number of separate parallel spaced spring-loaded rollers mounted below and substantially vertically aligned with the service opening;

means connecting one end of each curtain to one of said rollers respectively;

an air plenum chamber surrounding said rollers;

an elongated knife like nozzle joining the opposite end of said curtain members;

power driven means connected to said opposite end and operative when energized to unroll said curtains from said spring-loaded rollers and position them in closing relation to the service opening;

control means operable from the warm side of the opening to release said curtains from said power driven means to permit them to rewind on said rollers to open the service opening; and means for pressurizing said plenum chamber to circulate warm-side air between said curtains, through said nozzle and over the warm side of the outermost curtain to prevent condensation, maintain spacing therebetween and establish an air curtain across the opening when the curtains are in open position and during opening and closing cycles.

2. A closure as defined by claim 1 including vertically extending parallel seal surfaces on opposite sides of the surface opening, said surfaces being convex toward the warm side for engagement by opposite edges of said curtains when in the closed position the tension in said curtains due to said spring-loaded rollers serving to hold the side edges of said curtains against said seal surface.

3. A closure as defined by claim 2 in which said curtains include horizontally extending vertically spaced parallel stiffening ribs.

4. A closure as defined by claim 1 in which said curtains are of transparent synthetic resin material.

5. A closure as defined by claim 1 in which said power driven means includes an electric motor.

6. A closure as defined by claim 1 including two pairs of straight vertically extending rails, one on each side of the opening to define a channel for receiving and guiding the side edges of said curtains during opening and closing cycles and forming seal surfaces against which the edges of said curtains are held whenever said plenum chamber is pressurized.

* * * * *